US009527301B2

(12) United States Patent
Nakagawa et al.

(10) Patent No.: US 9,527,301 B2
(45) Date of Patent: Dec. 27, 2016

(54) LIQUID EJECTING APPARATUS

(71) Applicant: SEIKO EPSON CORPORATION, Tokyo (JP)

(72) Inventors: Shigenori Nakagawa, Tatsuno-machi (JP); Keiji Matsumoto, Matsumoto (JP); Toshinobu Yamazaki, Niigata (JP); Masahiko Sato, Matsumoto (JP); Makoto Otsuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/957,068

(22) Filed: Dec. 2, 2015

(65) Prior Publication Data

US 2016/0167390 A1 Jun. 16, 2016

(30) Foreign Application Priority Data

Dec. 15, 2014 (JP) ..... 2014-252767

(51) Int. Cl.
*B41J 2/18* (2006.01)
*B41J 2/20* (2006.01)
*B41J 2/175* (2006.01)

(52) U.S. Cl.
CPC ..... *B41J 2/17563* (2013.01)

(58) Field of Classification Search
CPC ..... B41J 2/175; B41J 2/17563; B41J 2/17596; B41J 2/185; B41J 2/18; B41J 2/20
USPC ..... 347/93
See application file for complete search history.

(56) References Cited

U.S. PATENT DOCUMENTS

2003/0196443 A1* 10/2003 Chang ..... F24D 17/02 62/135
2004/0012662 A1* 1/2004 Kneezel ..... B41J 2/1408 347/93
2006/0152562 A1* 7/2006 Ohishi ..... B41J 2/18 347/85
2008/0230468 A1* 9/2008 Brown ..... B41J 2/175 210/417
2013/0241980 A1* 9/2013 Akaba ..... B41J 2/175 347/6

FOREIGN PATENT DOCUMENTS

GB CA 2344999 A1 * 4/2000 ..... B41J 2/175
JP 2001-138538 A 5/2001
JP 2002-326370 A 11/2002
(Continued)

*Primary Examiner* — Geoffrey Mruk
*Assistant Examiner* — Scott A Richmond
(74) *Attorney, Agent, or Firm* — Workman Nydegger

(57) ABSTRACT

A liquid ejecting apparatus comprises: a supply passage through which liquid is supplied from a liquid supply source to a liquid ejecting unit; a filter housing portion provided in the supply passage, a first filter being provided inside the filter housing portion; a circulation passage forming portion, one end of which is connected to a space portion located closer to the liquid supply source than the first filter is, the other end of which is connected on the supply passage to a position closer to the liquid supply source than the first filter is, thereby forming a circulation passage; a foreign object separation unit that works with a flow pump, which is a pump for circulation of the liquid through the circulation passage, to cause a foreign object to come off from the first filter; and a second filter that is detachably provided on the circulation passage.

8 Claims, 4 Drawing Sheets

(56) References Cited

FOREIGN PATENT DOCUMENTS

| | | | |
|---|---|---|---|
| JP | 2003-326740 | A | 11/2003 |
| JP | 2005-131906 | A | 5/2005 |
| JP | 2014-131845 | A | 7/2014 |

* cited by examiner

LIQUID EJECTING APPARATUS

BACKGROUND

1. Technical Field

The present invention relates to a liquid ejecting apparatus, for example, an ink-jet printer.

2. Related Art

An ink-jet printer, which is an example of a liquid ejecting apparatus, performs printing by supplying ink (liquid) contained in a liquid supply source to a liquid ejecting unit through a supply passage and by ejecting the ink from nozzles of the liquid ejecting unit onto a medium.

Some known printers are provided with a filter for trapping a foreign object, for example, a precipitate out of ink or air bubbles, and perform filter maintenance when it is clogged. An example of such a printer is disclosed in JP-A-2005-131906. That is, such a printer reduces the clogging of a filter by causing ink to flow in the reverse direction from the nozzle side toward the liquid-supply-source side.

Due to the backflow of ink, air enters the liquid ejecting unit through the nozzles. For this reason, when the inside of the liquid ejecting unit and the supply passage is refilled with ink, it is necessary to perform the ink-filling operation while discharging the ink from the nozzles, resulting in wasteful ink consumption.

The problem described above is not limited to a printer that performs filter maintenance. The same problem arises in a liquid ejecting apparatus that performs filter maintenance.

SUMMARY

An advantage of some aspects of the invention is to provide a liquid ejecting apparatus that makes it possible to reduce the consumption of liquid when filter maintenance is performed.

Solving means according to some aspects, and operational effects thereof, are described below.

A liquid ejecting apparatus according to one aspect comprises: a liquid ejecting unit that ejects liquid from a nozzle; a supply passage through which the liquid is supplied from a liquid supply source to the nozzle of the liquid ejecting unit; a filter housing portion that constitutes a part of the supply passage, a first filter being provided inside the filter housing portion; a circulation passage forming portion, one end of which is connected to a space portion that is located closer to the liquid supply source than the first filter in the filter housing portion is, the other end of which is connected on the supply passage to a position closer to the liquid supply source than the first filter is, thereby forming a circulation passage that includes the space portion; a flow pump that is provided on the circulation passage and can cause the liquid to flow through the circulation passage when driven; a foreign object separation unit that works with the flow pump to cause a foreign object to come off from the first filter; and a second filter that is detachably provided on the circulation passage.

In this structure, due to the functioning of the foreign object separation unit and the driving of the flow pump, a foreign object on the first filter comes off from the first filter, and flows together with liquid through the circulation passage. Since the second filter is provided on the circulation passage, the foreign object having come off from the first filter is trapped by the second filter. Since the second filter is detachably provided on the circulation passage, it is possible to remove the foreign object having been trapped by the second filter by detachment of the second filter. That is, on the supply passage, the maintenance of the first filter is performed by means of the flow of liquid at the portion located closer to the liquid supply source than the first filter is, while suppressing the flow of liquid at the portion located closer to the nozzle than the first filter is. Therefore, it is possible to reduce the consumption of liquid when the maintenance of the first filter is performed.

Preferably, the liquid ejecting apparatus described above should further comprises: a cap that can hermetically close a space toward which the nozzle is oriented, wherein the liquid inside the circulation passage should be circulated by causing the foreign object separation unit to function in a state in which the space is hermetically closed by the cap, and by driving the flow pump.

With this structure, it is possible to reduce the risk of the entering of air through the nozzle by causing the foreign object separation unit to function in a state in which the space toward which the nozzle is oriented is hermetically closed by the cap, and by driving the flow pump.

In the liquid ejecting apparatus described above, preferably, the other end of the circulation passage forming portion should be connected on the supply passage to a position closer to the liquid supply source than the space portion is, the circulation passage forming portion working with the supply passage to constitute the circulation passage; and, on the supply passage, at a portion where the circulation passage is formed, a circulation direction, in which the flow pump causes the liquid to circulate, should be the same as a supply direction, in which the liquid is supplied from the liquid supply source to the nozzle.

In this structure, the circulation direction is the same as the supply direction in the circulating portion of the supply passage, that is, the portion that functions also as a part of the circulation passage. Therefore, it is possible to prevent a foreign object that has come off from the first filter, has flowed in the circulation direction, and has been trapped by the second filter from coming off from the second filter when liquid is supplied from the liquid supply source to the nozzle.

In the liquid ejecting apparatus described above, preferably, the foreign object separation unit should be a heating unit that can apply heat to the first filter; and the liquid inside the circulation passage should be circulated by driving the flow pump, with the first filter heated by the heating unit.

Some kinds of a foreign object such as a precipitate out of liquid soften or melt into the liquid when heated. With this structure, the heating of the first filter makes it easier for the foreign object on the first filter to come off from the first filter.

In the liquid ejecting apparatus described above, preferably, the foreign object separation unit should be a valve that switches between an open state, in which the liquid inside the circulation passage is allowed to circulate, and a closed state, in which the liquid inside the circulation passage is not allowed to circulate, and should be provided at a position where it is possible to render pressure of the space portion in the filter housing portion negative when the flow pump is driven with the valve closed.

In this structure, first, the flow pump is driven, with the valve on the circulation passage closed, to increase the negative pressure of the space portion in the filter housing portion. Next, the valve is opened. As compared with a case where the negative pressure is not increased, it is possible to cause the liquid inside the circulation passage to flow more rapidly. This makes it easier for the foreign object on the first filter to come off from the first filter.

In the liquid ejecting apparatus described above, preferably, the capability of the second filter for trapping the foreign object should be greater than that of the first filter. Since the trapping capability of the second filter is greater than that of the first filter, with this structure, it is easier to collect the foreign object at the second filter, which is detachable.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
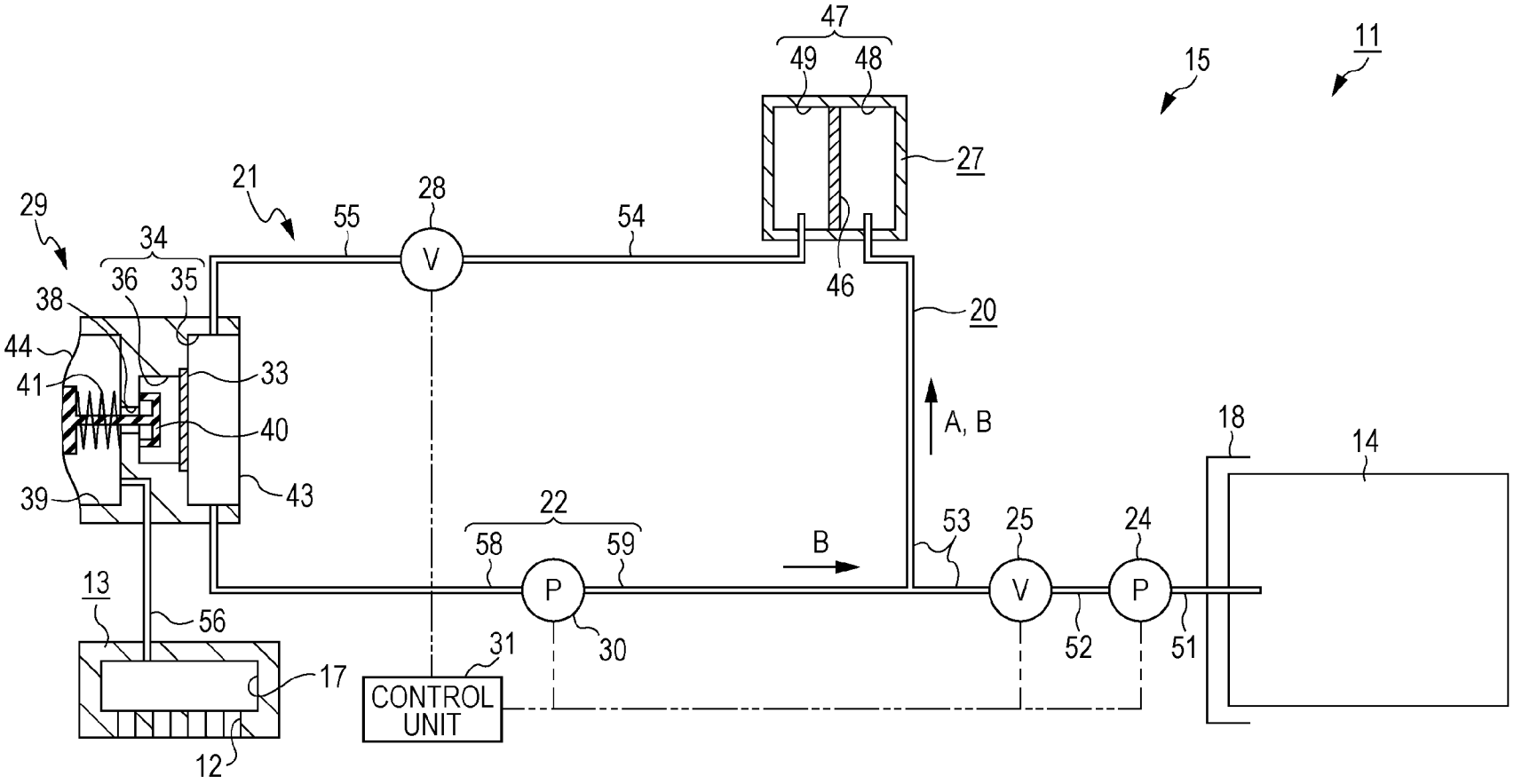
FIG. 1 is a schematic diagram of a printer according to a first embodiment.

As illustrated in FIG. 1, a liquid ejecting apparatus 11 according to the present embodiment includes a liquid ejecting unit 13, which ejects liquid (for example, ink) from nozzle(s) 12, and a supply mechanism 15, which can supply liquid contained in a liquid supply source 14 to the liquid ejecting unit 13.

The liquid ejecting unit 13 includes at least one nozzle 12 (plural nozzles in the present embodiment) 12 in the nozzle surface and a reservoir 17. The reservoir 17 is in communication with each of the nozzles 12. The liquid supply source 14 is a container that can contain liquid. For example, it may be a replaceable cartridge for replenishment of liquid. Alternatively, it may be a tank fixed to an attachment portion 18. If the liquid supply source 14 is a cartridge, the attachment portion 18 holds the liquid supply source 14 detachably. The attachment portion 18 of the present embodiment is capable of holding plural liquid supply sources 14 containing different types or colors of liquid.

The supply mechanism 15 includes a supply passage 20 and a circulation passage forming portion 22. Liquid is supplied through the supply passage 20 from the liquid supply source 14, which is located at the upstream side, to the nozzles 12 of the liquid ejecting unit 13, which is located at the downstream side. The circulation passage forming portion 22 and the supply passage 20 work together to constitute a circulation passage 21. A supply pump 24 and a supply valve 25 are provided on the supply passage 20 each at a position closer to the liquid supply source 14 than the portion where the circulation passage 21 is formed is. The supply pump 24 causes liquid to flow in a supply direction A, which is from the liquid supply source 14 toward the nozzles 12. The supply valve 25 can restrict the flow of liquid through the supply passage 20.

A filter unit 27, an open/close valve 28, which switches between an open state and a closed state, and a pressure regulation valve 29, which regulates the pressure of liquid, are provided in the circulating portion of the supply passage 20, that is, the portion that functions also as a part of the circulation passage 21. The liquid inside the circulation passage 21 is allowed to circulate when the open/close valve 28 is open and is not allowed to circulate when the open/close valve 28 is closed. The open/close valve 28 is an example of a foreign object separation unit. In the circulation passage forming portion 22, a flow pump 30 is provided on the circulation passage 21. The flow pump 30 can cause liquid to flow through the circulation passage 21 when it is driven.

The supply pump 24 and the flow pump 30 are, for example, gear pumps or diaphragm pumps. The liquid ejecting apparatus 11 includes a control unit 31 that controls the driving of the supply pump 24, the supply valve 25, the open/close valve 28, and the flow pump 30.

The pressure regulation valve 29, which constitutes a part of the supply passage 20, includes a filter housing portion 34, inside which a first filter 33 is provided. The filter housing portion 34 includes an upstream-side space portion 35, which is an example of a space portion that is located closer to the liquid supply source 14 than the first filter 33 is, and a downstream-side space portion 36, which is located closer to the nozzles 12 than the first filter 33 is.

The pressure regulation valve 29 further includes a pressure compartment 39, which is in communication with the downstream-side space portion 36 through a communication hole 38, a valve element 40, which is provided between the pressure compartment 39 and the downstream-side space portion 36, and an urging member 41, which urges the valve element 40 in a closing direction. That is, the valve element 40 is inserted through the communication hole 38. The communication hole 38 is closed by the valve element 40 urged by the urging member 41.

A part of the wall surface of the upstream-side space portion 35 is made of a deformable upstream-side diaphragm 43. A part of the wall surface of the pressure compartment 39 is made of a deformable downstream-side diaphragm 44. The upstream-side diaphragm 43 and the downstream-side diaphragm 44 deform in accordance with a change in pressure inside the upstream-side space portion 35 and a change in pressure inside the pressure compartment 39, respectively.

Specifically, the outer surface of the upstream-side diaphragm 43 of the upstream-side space portion 35 (the right side in FIG. 1) receives atmospheric pressure. The inner surface thereof (the left side in FIG. 1) receives the pressure of liquid retained inside the upstream-side space portion 35. Receiving the pressure, the upstream-side diaphragm 43 deforms in such a way as to change the capacity of the upstream-side space portion 35. On the other hand, the outer surface of the downstream-side diaphragm 44 of the pressure compartment 39 (the left side in FIG. 1) receives atmospheric pressure. The inner surface thereof (the right side in FIG. 1) receives the pressure of liquid retained inside the pressure compartment 39 and further receives the urging force of the urging member 41. The downstream-side diaphragm 44 deforms in the urging direction of the urging member 41.

The filter housing portion 34 is kept in a pressurized state by pressurized liquid supplied from the liquid supply source 14. When the pressure difference between the internal pressure of the pressure compartment 39 and the external pressure applied to the outer surface becomes less than a predetermined pressure value, a change into a state of communication between the pressure compartment 39 and the downstream-side space portion 36 from a non-communication state, in which the communication between the pressure compartment 39 and the downstream-side space portion 36 is stopped by the valve element 40 urged by the urging member 41, occurs. When the pressure difference between the internal pressure of the pressure compartment 39 and the external pressure applied to the outer surface reaches the predetermined pressure value, the valve element 40 stops the communication between the pressure compartment 39 and the downstream-side space portion 36. In this way, in order to regulate the internal pressure of the liquid ejecting unit 13, which is the back pressure of the nozzles 12, the pressure regulation valve 29 regulates the pressure of liquid supplied from the liquid supply source 14 through the supply passage 20.

The filter unit 27, which constitutes a part of the supply passage 20 and the circulation passage 21, includes a housing portion 47, inside which a second filter 46 is provided. On the supply passage 20, the housing portion 47 includes an upstream compartment 48, which is located closer to the liquid supply source 14 than the second filter 46 is, and a downstream compartment 49, which is located closer to the nozzles 12 than the second filter 46 is. The filter unit 27 is detachable from the circulation passage 21. That is, the whole filter unit 27 including the second filter 46 is detachable from the circulation passage 21. The capability of the second filter 46 for trapping a foreign object is greater than the trapping capability of the first filter 33.

The supply passage 20 is made up of plural (six in the present embodiment) connection passages, that is, first to sixth connection passages 51 to 56. Specifically, the first connection passage 51 connects the liquid supply source 14 to the supply pump 24. The second connection passage 52 connects the supply pump 24 to the supply valve 25. The third connection passage 53 connects the supply valve 25 to the upstream compartment 48 of the filter unit 27. The fourth connection passage 54 connects the downstream compartment 49 of the filter unit 27 to the open/close valve 28. The fifth connection passage 55 connects the open/close valve 28 to the upstream-side space portion 35 of the pressure regulation valve 29. The sixth connection passage 56 connects the pressure compartment 39 of the pressure regulation valve 29 to the reservoir 17 of the liquid ejecting unit 13.

The circulation passage forming portion 22 is made up of a first branch passage 58, which connects the upstream-side space portion 35 of the pressure regulation valve 29 to the flow pump 30, and a second branch passage 59, which connects the flow pump 30 to the third connection passage 53. That is, one end of the circulation passage forming portion 22 is connected to the upstream-side space portion 35, which is located closer to the liquid supply source 14 than the first filter 33, which is provided inside the filter housing portion 34, is. The other end of the circulation passage forming portion 22 is connected to the third connection passage 53, which is, in the supply passage 20, located closer to the liquid supply source 14 than the second filter 46 is. In other words, the other end of the circulation passage forming portion 22 is connected on the supply passage 20 to a position closer to the liquid supply source 14 than the upstream-side space portion 35 is, thereby forming the circulation passage 21 including the upstream-side space portion 35.

The supply passage 20 is a passage located between the liquid supply source 14 and the nozzles 12. That is, the supply passage 20 is made up of the first to sixth connection passages 51 to 56, the housing portion 47 of the filter unit 27, the filter housing portion 34 of the pressure regulation valve 29, the communication hole 38 thereof, the pressure compartment 39 thereof, and the reservoir 17 of the liquid ejecting unit 13. The circulation passage 21 is made up of the third, fourth, and fifth connection passages 53, 54, and 55, the upstream-side space portion 35 in the filter housing portion 34, the first branch passage 58, and the second branch passage 59.

The open/close valve 28, the upstream-side space portion 35, and the flow pump 30 are provided on the circulation passage 21 in this order in a circulation direction B from the filter unit 27. The open/close valve 28 is provided on the circulation passage 21 at a position where it is possible to render the pressure of the upstream-side space portion 35 in the filter housing portion 34 negative when the flow pump 30 is driven with the open/close valve 28 closed. That is, the upstream-side space portion 35 is located between the open/close valve 28 and the flow pump 30, and no other passage is connected to the fifth connection passage 55 between the open/close valve 28 and the upstream-side space portion 35 and to the first branch passage 58 between the upstream-side space portion 35 and the flow pump 30.

The circulation direction B is a direction in which the flow pump 30 causes the liquid inside the circulation passage 21 to circulate. The flow pump 30 causes the liquid to flow in such a way that the circulation direction B is the same as the supply direction A from the liquid supply source 14 to the nozzles 12.

Next, operation performed for maintenance of the first filter 33 of the liquid ejecting apparatus 11, which has the structure described above, will now be explained, with a focus on the operation of the supply mechanism 15.

For ejection of liquid from the nozzles 12 onto a target (for example, paper) that is not illustrated, the control unit 31 opens the supply valve 25 and drives the supply pump 24. As a result, liquid in the second to fifth connection passages 52 to 55, the first branch passage 58, the second branch passage 59, the filter housing portion 34, and the housing portion 47 between the supply pump 24 and the valve element 40 is pressurized.

When pressure at the nozzle side 12 becomes negative as compared with pressure at the valve-element side 40 due to the ejection of liquid from the nozzles 12, the valve element 40 moves toward the filter housing portion 34, and liquid is supplied from the filter housing portion 34 to the pressure compartment 39. The first filter 33 and the second filter 46 trap a foreign object when liquid passes therethrough in this way.

Figure 2:
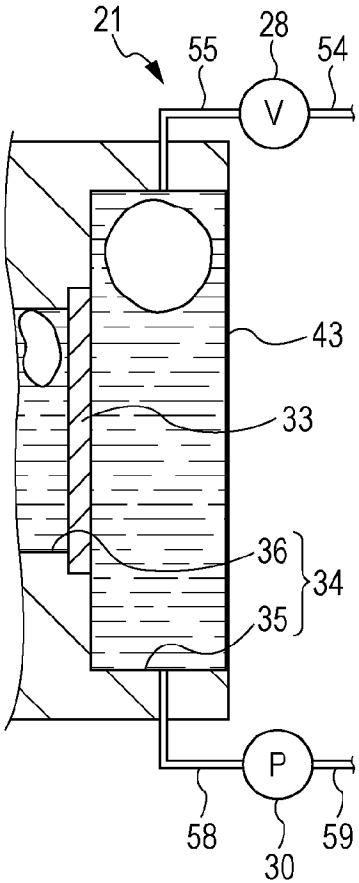
FIG. 2 is a schematic diagram of a filter housing portion before maintenance.

As illustrated in FIG. 2, it is assumed that air bubbles, as an example of a foreign object, exist in the upstream-side space portion 35 and the downstream-side space portion 36 and that the first filter 33 is clogged due to deposition of a foreign object such as a precipitate out of liquid.

When the maintenance of the first filter 33 is performed, the control unit 31 stops the driving of the supply pump 24 and closes the supply valve 25. In addition, the control unit 31 drives the flow pump 30, with the open/close valve 28 closed. Next, the control unit 31 drives the flow pump 30, with the open/close valve 28 open, to cause the liquid inside the circulation passage 21 to circulate.

That is, first, the control unit 31 closes the open/close valve 28, and drives the flow pump 30 in a state in which the portion downstream of the open/close valve 28 on the circulation passage 21 in the circulation direction B is not in communication with the portion upstream thereof. As a result, negative pressure accumulates in the fifth connection passage 55, the upstream-side space portion 35, the downstream-side space portion 36, and the first branch passage 58 between the open/close valve 28 and the flow pump 30. That is, the control unit 31 drives the flow pump 30 in such a way that the negative pressure of the downstream-side space portion 36 is not excessively negative to an extent that the valve element 40 moves. Therefore, in a state in which a change in pressure is suppressed at the portion located closer to the nozzles 12 than the pressure compartment 39 is, negative pressure increases at the portion located closer to the liquid supply source 14 than the valve element 40 is.

Figure 3:
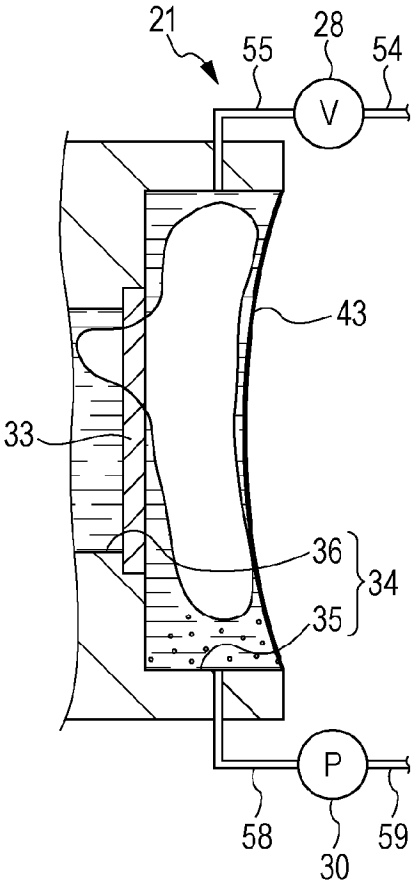
FIG. 3 is a schematic diagram of the filter housing portion during maintenance.

As illustrated in FIG. 3, the deformation of the upstream-side diaphragm 43 toward the first filter 33 occurs at the upstream-side space portion 35 when the negative pressure of the upstream-side space portion 35 increases. Therefore, the capacity of the upstream-side space portion 35 decreases. Moreover, air bubbles expand inside the upstream-side space portion 35 and the downstream-side space portion 36 as the negative pressure increases. As a result, a foreign object on the first filter 33, for example, a precipitate out of liquid, comes off from the first filter 33, or it becomes easier for the foreign object to come off therefrom. If the size of air bubbles inside the upstream-side space portion 35 and the downstream-side space portion 36 is large, in some cases, the swollen air bubbles merge into one.

Figure 4:
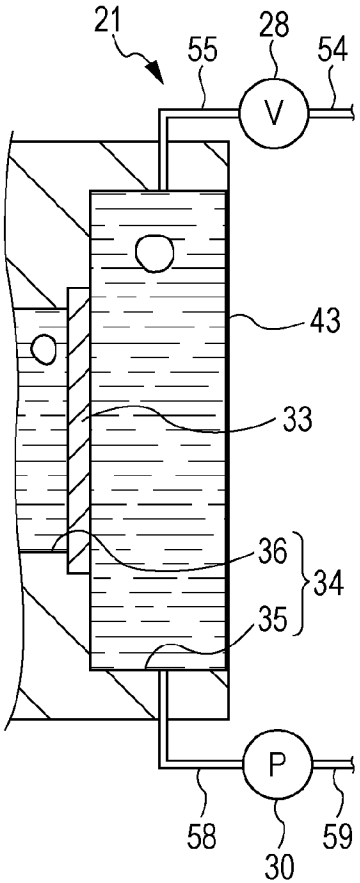
FIG. 4 is a schematic diagram of a filter housing portion after maintenance.

Next, as illustrated in FIG. 4, the control unit 31 opens the open/close valve 28. That is, the control unit 31 drives the flow pump 30 in a state in which the portion downstream of the open/close valve 28 on the circulation passage 21 in the circulation direction B is in communication with the portion upstream thereof, thereby causing the liquid inside the circulation passage 21 to circulate. As a result, the liquid rushes into the upstream-side space portion 35, the negative pressure of which was high, from the fifth connection passage 55. In addition, a foreign object such as the air bubble inside the upstream-side space portion 35 flows out to the first branch passage 58. Entrained by the air bubble inside the upstream-side space portion 35, the air bubble inside the downstream-side space portion 36 also flows out to the first branch passage 58. Therefore, the open/close valve 28 works with the flow pump 30 to cause the foreign object to come off from the first filter 33.

As illustrated in FIG. 1, the foreign object having come off from the first filter 33, for example, air bubbles or a precipitate, flows together with the liquid through the circulation passage 21, enters the filter unit 27, and is trapped by the second filter 46.

After the maintenance of the first filter 33 performed once or more in this way, the control unit 31 drives an alarm unit that is not illustrated to let the user know that the replacement of the filter unit 27 is necessary.

The first embodiment described above produces the following advantageous effects.

(1) Due to the opening and closing of the open/close valve 28 and the driving of the flow pump 30, a foreign object on the first filter 33 comes off from the first filter 33, and flows together with liquid through the circulation passage 21. Since the second filter 46 is provided on the circulation passage 21, the foreign object having come off from the first filter 33 is trapped by the second filter 46. Since the second filter 46 is detachably provided on the circulation passage 21, it is possible to remove the foreign object having been trapped by the second filter 46 by detachment of the second filter 46. That is, on the supply passage 20, the maintenance of the first filter 33 is performed by means of the flow of liquid at the portion located closer to the liquid supply source 14 than the first filter 33 is, while suppressing the flow of liquid at the portion located closer to the nozzles 12 than the first filter 33 is. Therefore, it is possible to reduce the consumption of liquid when the maintenance of the first filter 33 is performed.

(2) On the supply passage 20, the circulation direction B is the same as the supply direction A through the third, fourth, and fifth connection passages 53, 54, and 55, which function also as the circulation passage 21. Therefore, it is possible to prevent a foreign object that has come off from the first filter 33, has flowed in the circulation direction B, and has been trapped by the second filter 46 from coming off from the second filter 46 when liquid is supplied from the liquid supply source 14 to the nozzles 12.

(3) First, the flow pump 30 is driven, with the open/close valve 28 on the circulation passage 21 closed, to increase the negative pressure of the upstream-side space portion 35 in the filter housing portion 34. Next, the open/close valve 28 is opened. As compared with a case where the negative pressure is not increased, it is possible to cause the liquid inside the circulation passage 21 to flow more rapidly. This makes it easier for the foreign object on the first filter 33 to come off from the first filter 33.

(4) Since the capability of the second filter 46 for trapping a foreign object is greater than that of the first filter 33, it is easier to collect the foreign object at the second filter 46, which is detachable.

(5) If the liquid ejecting unit 13 is refilled with liquid after the backflow of liquid from the nozzles 12 toward the liquid supply source 14 for the purpose of, for example, the maintenance of the first filter 33, in some cases, air having entered through the nozzles 12 remains in the form of air bubbles. If such an air bubble remains in the neighborhood of a nozzle 12, there is a risk that poor ejection called as nozzle-dot missing might occur. In this respect, on the supply passage 20, the maintenance of the first filter 33 is performed by means of the flow of liquid at the portion located closer to the liquid supply source 14 than the first filter 33 is, while suppressing the flow of liquid at the portion located closer to the nozzles 12 than the first filter 33 is. Therefore, it is possible to perform the maintenance of the first filter 33 while reducing the risk of poor ejection.

(6) For example, if the negative pressure of the filter housing portion 34 increases when there is an air bubble inside the filter housing portion 34, the air bubble expands. The air bubble contracts if the positive pressure of the filter housing portion 34 increases. Since the maintenance of the first filter 33 is performed by changing the pressure of liquid inside the circulation passage 21 by means of the open/close valve 28 and the flow pump 30, it is possible to cause a foreign object on the first filter 33 to come off easily by utilizing the expansion and contraction of an air bubble staying inside the filter housing portion 34. Moreover, since a part of the upstream-side space portion 35 is made of a flexible upstream-side diaphragm 43, capacity decreases when the pressure is negative. Therefore, it is possible to cause the air bubble to expand efficiently.

Second Embodiment

Next, with reference to FIG. 5, a liquid ejecting apparatus according to a second embodiment will now be explained. The second embodiment is different from the first embodiment in that the apparatus does not include the pressure compartment 39 and the valve element 40. Except for this point of difference, the structure of the second embodiment is substantially the same as the structure of the first embodiment. Therefore, the same reference numerals are assigned to the same components, and an explanation of them is not given here.

Figure 5:
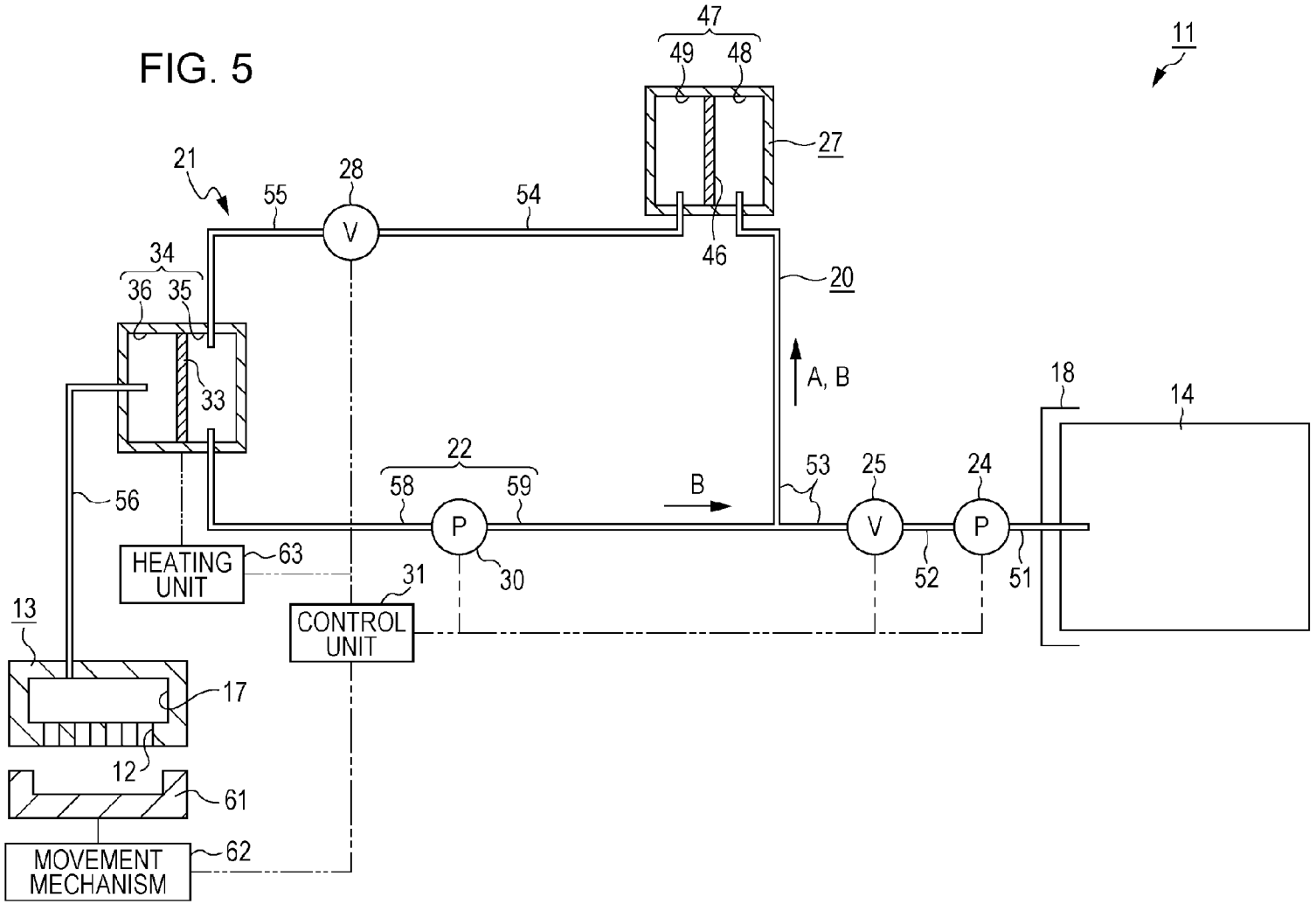
FIG. 5 is a schematic diagram of a printer according to a second embodiment.

As illustrated in FIG. 5, the liquid ejecting apparatus 11 includes a cap 61, which can hermetically close a space toward which the nozzles 12 are oriented, and a movement mechanism 62, which causes the cap 61 to move in relation to the liquid ejecting unit 13. The cap 61 has a shape of an open-topped box with a bottom. Driven by the movement mechanism 62, the cap 61 can move toward the liquid ejecting unit 13 to enclose the space toward which the nozzles 12 are oriented. In the present embodiment, the operation of hermetically closing, by the cap 61, the space toward which the nozzles 12 are oriented is called as "capping". The control unit 31 controls the driving of the movement mechanism 62, too.

The liquid ejecting unit 13 includes a heating unit 63, which can apply heat to the first filter 33. The heating unit 63 is an example of a foreign object separation unit. The upstream end of the sixth connection passage 56 is connected to the downstream-side space portion 36 in the filter housing portion 34. The control unit 31 controls the driving of the heating unit 63, too.

Next, operation performed for maintenance of the first filter 33 of the liquid ejecting apparatus 11, which has the structure described above, will now be explained. The control unit 31 drives the movement mechanism 62 for capping the liquid ejecting unit 13, thereby hermetically closing, by the cap 61, the space toward which the nozzles 12 are oriented. The control unit 31 closes the supply valve 25 and the open/close valve 28, and causes the heating unit 63 to apply heat to the first filter 33. Next, the control unit 31 drives the flow pump 30 for circulation of the liquid inside the circulation passage 21.

Due to the heating of the first filter 33, a foreign object such as a precipitate on the first filter 33 softens or melts, which makes it easier for the foreign object to come off from the first filter 33.

When the flow pump 30 is driven, negative pressure accumulates in the upstream-side space portion 35 and the downstream-side space portion 36 in the filter housing portion 34, the sixth connection passage 56, and the reservoir 17 of the liquid ejecting unit 13 in addition to the fifth connection passage 55 and the first branch passage 58. However, since the liquid ejecting unit 13 is capped, the entering of air through the nozzles 12 is suppressed.

The control unit 31 opens the open/close valve 28, and drives the flow pump 30. As a result, the liquid rushes into the upstream-side space portion 35, the negative pressure of which was high, from the fifth connection passage 55, and, in addition, a foreign object inside the upstream-side space portion 35 flows out to the first branch passage 58, as in the first embodiment.

Since the liquid ejecting unit 13 is capped, on the supply passage 20, at the portion located closer to the nozzles 12 than the first filter 33 is, the flow of liquid is suppressed. For this reason, the foreign object having come off from the first filter 33 flows together with the liquid through the circulation passage 21, enters the filter unit 27, and is trapped by the second filter 46.

The second embodiment described above produces the following advantageous effect in addition to the advantageous effects (1) to (6) of the first embodiment.

(7) It is possible to reduce the risk of the entering of air through the nozzles 12 by causing the open/close valve 28 and the heating unit 63 to function in a state in which the space toward which the nozzles 12 are oriented is hermetically closed by the cap 61, and by driving the flow pump 30.

(8) Some kinds of a foreign object such as a precipitate out of liquid soften or melt into the liquid when heated. The heating of the first filter 33 makes it easier for the foreign object on the first filter 33 to come off from the first filter 33.

The foregoing embodiments may be modified as follows.

Figure 6:
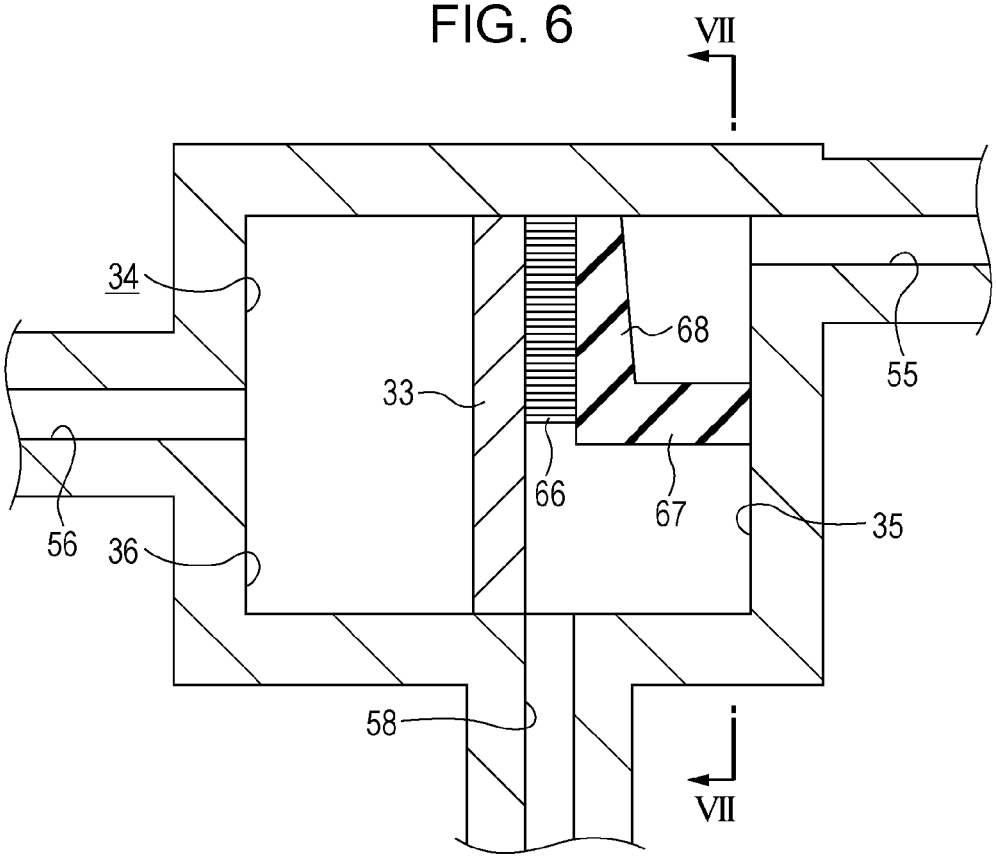
FIG. 6 is a schematic sectional view of a filter housing portion according to a variation example.
Figure 7:
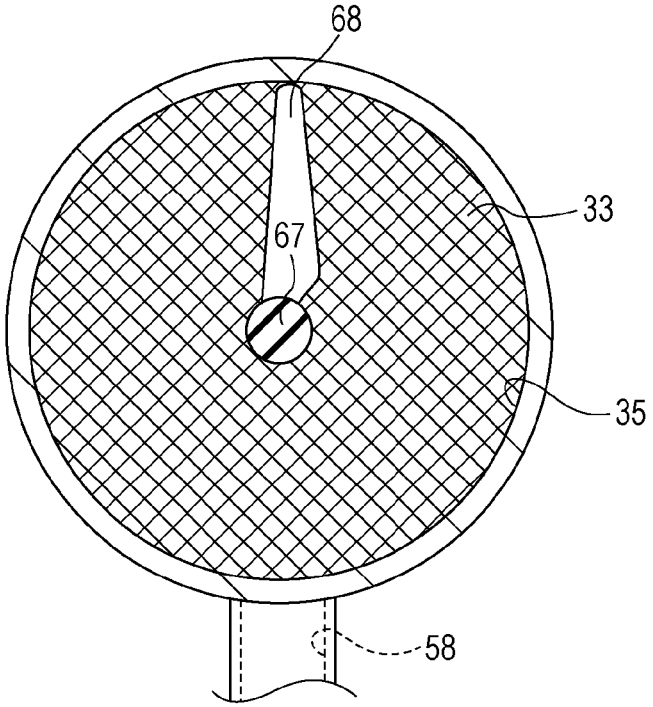
FIG. 7 is a sectional view taken along the line VII-VII of FIG. 6.

As illustrated in FIGS. 6 and 7, the filter housing portion 34 may be equipped with a brush 66, which is an example of a foreign object separation unit, in the upstream-side space portion 35 (variation example). The brush 66 is provided on a blade 68, which rotates upon an axis 67 in accordance with the flow of liquid from the fifth connection passage 55 into the upstream-side space portion 35. The brush 66 rotates together with the blade 68 to brush a foreign object off the first filter 33. When the flow pump 30 is driven for circulation of the liquid inside the circulation passage 21, the foreign object having been brushed off the first filter 33 flows out to the first branch passage 58, flows through the circulation passage 21, and is trapped by the second filter 46.

If, for example, a filter made of nonwoven fabric or the like is used as the first filter 33, there is a risk that some fibers of the fabric might come loose and become a foreign object due to abrasion by the brush 66. Therefore, preferably, a ceramic filter or a metal mesh filter having great resistance should be used as the first filter 33 of this variation example.

In this variation example, when the flow pump 30 is driven for circulation of the liquid inside the circulation passage 21, the brush 66 rotates together with the blade 68 to brush a foreign object off the first filter 33. That is, it is possible to operate the brush 66 by driving the flow pump 30.

In each of the foregoing embodiments, the open/close valve 28 may be a three-way valve that can switch the state of communication between the portion upstream of the open/close valve 28 and the portion downstream thereof on the supply passage 20 in the supply direction A and can bring the supply passage 20 into communication with the outside air. If the open/close valve 28 is a three-way valve, first, the control unit 31 drives the flow pump 30 in a state in which the supply passage 20 is in communication with the outside air. Next, the control unit 31 drives the flow pump 30 in a state in which the fourth connection passage 54 is in communication with the fifth connection passage 55 and which the supply passage 20 is not in communication with the outside air. The switching between the non-communication/communication of the supply passage 20 and the outside air may be performed plural times. When the open/close valve 28 and the flow pump 30 are driven in this way, air bubbles are taken into the circulation passage 21. In this state, the control unit 31 drives the open/close valve 28 to bring the portion downstream of the open/close valve 28 on the supply passage 20 in the supply direction A into non-communication with the portion upstream thereof, and drives the flow pump 30. As a result, the air bubble expands. Next, when the control unit 31 brings the supply passage 20 into communication, the air bubble contracts. Due to the contraction, the speed of the flow of the liquid through the circulation passage 21 increases, which makes it easier for the foreign object on the first filter 33 to come off.

In each of the foregoing embodiments, the supply valve 25 may be connected directly to the upstream-side space portion 35 through a connection passage. That is, except for the upstream-side space portion 35, which is shared, the circulation passage 21 and the supply passage 20 may be independent of each other. In other words, the upstream and downstream ends of the circulation passage forming portion 22 may be connected to the upstream-side space portion 35, and the circulation passage forming portion 22 and the upstream-side space portion 35 may make up the circulation passage 21. In such a case, the filter unit 27, the open/close valve 28, and the flow pump 30 are provided in the circulation passage forming portion 22.

In each of the foregoing embodiments, it is not always necessary that the cross-sectional area of the filter housing portion 34 orthogonal to the supply direction A should be the same as the cross-sectional area of the fifth connection passage 55. For example, the two may be equal to each other. That is, the first filter 33 may be provided somewhere on the connection passage, and the portion upstream of the first filter 33 and the portion downstream of the first filter 33 may serve as the fifth connection passage 55 and the sixth connection passage 56, respectively. One end of the circulation passage forming portion 22 can be connected to a position where it is possible to cause liquid in contact with the first filter 33 to flow after liquid circulation through the circulation passage 21. In such a case, the portion from the first filter 33 to the position where one end of the circulation passage forming portion 22 is connected is an example of a space portion that is located closer to the liquid supply source 14 than the first filter 33 is.

In each of the foregoing embodiments, the area size of the second filter 46 may be larger than the area size of the first filter 33.

In each of the foregoing embodiments, the trapping capability of the second filter 46 may be the same as that of the first filter 33. The trapping capability of the first filter 33 may be greater than that of the second filter 46.

In the second embodiment, the open/close valve 28 may be omitted. That is, the circulation of the liquid through the circulation passage 21 may be performed when it becomes easier for the foreign object to come off from the first filter 33 due to the heating of the first filter 33 by the heating unit 63.

In the second embodiment, the heating unit 63 may apply heat to liquid inside the portion upstream of the first filter 33 for indirectly heating the first filter 33 via the liquid. That is, the first filter 33 is heated due to the heat conduction of the heated liquid and the flow of the heated liquid to the first filter 33.

In the second embodiment, the heating unit 63 may be omitted.

In each of the foregoing embodiments, the circulation direction B may be the opposite of the supply direction A on the supply passage 20.

In each of the foregoing embodiments, the first filter 33 may be provided on the supply passage 20 inside the liquid ejecting unit 13. For example, the filter may be provided inside the reservoir 17.

In each of the foregoing embodiments, the filter unit 27 may be provided at any position on the circulation passage 21. For example, the filter unit 27 may be provided between the open/close valve 28 and the upstream-side space portion 35, or in the circulation passage forming portion 22.

In each of the foregoing embodiments, the liquid ejecting apparatus may eject and/or discharge any liquid other than ink. Examples of the state of a droplet outputted as an ultra-small amount of the liquid from the liquid ejecting apparatus are: a particulate droplet, a tear-shaped droplet, and a viscous droplet that forms a thread tail. The "liquid" mentioned herein may be made of any material as long as it can be ejected from the liquid ejecting apparatus. Any material whose substance is in the liquid phase can be used, for example: liquid that has high viscosity or low viscosity, sol or gel water, or other fluid such as inorganic solvent, organic solvent, solution, liquid resin, or liquid metal (metal melt), though not limited thereto. Liquid described in the foregoing embodiments, liquid crystal, etc. are typical examples of "liquid". "Liquid" encompasses various kinds having various liquid compositions such as popular water-based liquid, oil-based liquid, gel liquid, and hot melt liquid, etc. A specific example of the liquid ejecting apparatus is: an apparatus that ejects liquid in which, for example, a material such as an electrode material, a color material, or the like that is used in the production of a liquid crystal display, an EL (electroluminescence) display, a surface emission display, a color filter, or the like is dispersed or dissolved. The liquid ejecting apparatus may be an apparatus that ejects a living organic material used for production of biochips, or is used as a high precision pipette and ejects a liquid sample, a textile printing apparatus, or a micro dispenser, etc. The liquid ejecting apparatus may be an apparatus that ejects, with high precision, lubricating oil onto precision equipment, for example, a watch or a camera. The liquid ejecting apparatus may be an apparatus that ejects liquid of a transparent resin such as an ultraviolet ray curing resin, etc. onto a substrate so as to form a micro hemispherical lens (optical lens) that is used in an optical communication element, etc. The liquid ejecting apparatus may be an apparatus that ejects an etchant such as acid or alkali that is used for the etching of a substrate, etc.

The entire disclosure of Japanese Patent Application No. 2014-252767, filed Dec. 15, 2014 is expressly incorporated by reference herein.

What is claimed is:

1. A liquid ejecting apparatus, comprising:

a liquid ejecting unit that ejects liquid from a nozzle;

a supply passage through which the liquid is supplied from a liquid supply source to the nozzle of the liquid ejecting unit;

a filter housing portion that constitutes a part of the supply passage, the filter housing portion including a first filter configured to trap a foreign object and a space portion located closer to the liquid supply source than the first filter in the supply passage;

a connection passage forming a circulation passage in cooperation with the supply passage, the connection passage connecting the space portion and a connection portion of the supply passage closer to the liquid supply source than the space portion so that the circulation passage includes the space portion;

a flow pump configured to cause the liquid to flow through the circulation passage when driven;

a foreign object separation unit configured to cause the foreign object to come off from the first filter in cooperation with the flow pump; and a second filter that is detachably provided on the circulation passage, the second filter being located so that the liquid inside the circulation passage passes through the second filter, wherein the circulation passage is a closed loop passage that includes the filter housing portion, the second filter, and the flow pump.

2. The liquid ejecting apparatus according to claim 1, further comprising:

a cap that can hermetically close a space toward which the nozzle is oriented, wherein the liquid inside the circulation passage is circulated by causing the foreign object separation unit to function in a state in which the space is hermetically closed by the cap, and by driving the flow pump.

3. The liquid ejecting apparatus according to claim 1, wherein the connection portion is located closer to the liquid supply source than the second filter, and wherein, on a region of the supply passage forming the circulation passage, a circulation direction in which the flow pump causes the liquid to circulate is the same as a supply direction in which the liquid is supplied from the liquid supply source to the nozzle.

4. The liquid ejecting apparatus according to claim 1, wherein the foreign object separation unit is a heating unit that can apply heat to the first filter; and wherein the liquid inside the circulation passage is circulated by driving the flow pump, with the first filter heated by the heating unit.

5. The liquid ejecting apparatus according to claim 1, wherein the foreign object separation unit is a valve that switches between an open state, in which the liquid inside the circulation passage is allowed to circulate, and a closed state, in which the liquid inside the circulation passage is not allowed to circulate, and is provided at a position where it is possible to render a pressure of the space portion in the filter housing portion negative when the flow pump is driven with the valve closed.

6. The liquid ejecting apparatus according to claim 1, wherein a capability of the second filter for trapping the foreign object is greater than that of the first filter.

7. A liquid ejecting apparatus, comprising:

a liquid ejecting unit that ejects liquid from a nozzle;

a supply passage through which the liquid is supplied from a liquid supply source to the nozzle of the liquid ejecting unit;

a filter housing portion that constitutes a part of the supply passage, the filter housing portion including a first filter configured to trap a foreign object;

a connection passage forming a circulation passage in cooperation with the supply passage, the connection passage connecting the filter housing portion and a connection portion of the supply passage closer to the liquid supply source than the filter housing portion so that the circulation passage includes the filter housing portion;

a flow pump configured to cause the liquid to flow through the circulation passage when driven; and a foreign object separation unit configured to cause the foreign object to come off from the first filter in cooperation with the flow pump, wherein, on a region of the supply passage forming the circulation passage, a circulation direction in which the flow pump causes the liquid to circulate is the same as a supply direction in which the liquid is supplied from the liquid supply source to the nozzle, a second filter that is detachably provided on the circulation passage, the second filter being located so that the liquid inside the circulation passage passes through the second filter, wherein the circulation passage is a closed loop passage that includes the filter housing portion, the second filter, and the flow pump.

8. A liquid ejecting apparatus, comprising:

a liquid ejecting unit that ejects liquid from a nozzle;

a supply passage through which the liquid is supplied from a liquid supply source to the nozzle of the liquid ejecting unit;

a filter housing portion that constitutes a part of the supply passage, the filter housing portion including a first filter configured to trap a foreign object and a space portion located closer to the liquid supply source than the first filter in the supply passage;

a connection passage forming a circulation passage in cooperation with the supply passage, the connection passage connecting the filter housing portion and a connection portion of the supply passage closer to the liquid supply source than the filter housing portion so that the circulation passage includes the filter housing portion;

a flow pump configured to cause the liquid to flow through the circulation passage when driven; and a foreign object separation unit configured to cause the foreign object to come off from the first filter, the foreign object separation unit including a valve that switches between an open state in which the liquid inside the circulation passage is allowed to circulate and a closed state in which the liquid inside the circulation passage is not allowed to circulate, the valve being provided at a position where it is possible to render a pressure of the space portion in the filter housing portion negative when the flow pump is driven with the valve closed.

* * * * *